US006874974B2

(12) United States Patent
VanBuskirk et al.

(10) Patent No.: US 6,874,974 B2
(45) Date of Patent: Apr. 5, 2005

(54) REINFORCED SOIL ARCH

(75) Inventors: Calvin D. VanBuskirk, Salmon Arm (CA); Ronald J. Neden, Armstrong (CA)

(73) Assignee: Terratech Consulting Ltd., Salmon Arm (CA)

( * ) Notice: Subject to any disclaimer, the term of this patent is extended or adjusted under 35 U.S.C. 154(b) by 0 days.

(21) Appl. No.: 10/614,259

(22) Filed: Jul. 8, 2003

(65) Prior Publication Data

US 2004/0179899 A1 Sep. 16, 2004

Related U.S. Application Data

(60) Provisional application No. 60/452,949, filed on Mar. 10, 2003.

(51) Int. Cl.[7] ..... E01F 5/00

(52) U.S. Cl. ..... 405/124; 405/126; 405/149

(58) Field of Search ..... 405/150.1, 124, 405/125, 126, 146, 151, 153, 149; 249/11, 209

(56) References Cited

U.S. PATENT DOCUMENTS

| | | | | |
|---|---|---|---|---|
| 3,508,406 A | * | 4/1970 | Fisher | 405/124 |
| 4,010,617 A | * | 3/1977 | Fisher | 405/150.1 |
| 4,605,338 A | * | 8/1986 | Peterson | 405/124 |
| 4,618,283 A | | 10/1986 | Hilfiker | 405/124 |
| 6,050,746 A | | 4/2000 | McCavour et al. | 405/124 |

FOREIGN PATENT DOCUMENTS

| | | | |
|---|---|---|---|
| CA | 1056169 | 6/1979 | 61/36 |
| CA | 1340179 | 12/1998 | E01F/5/00 |
| CA | 2254595 | 6/1999 | E01F/5/00 |

* cited by examiner

*Primary Examiner*—Heather Shackelford
*Assistant Examiner*—Lisa M. Saldano
(74) *Attorney, Agent, or Firm*—Oyen Wiggs Green & Mutala, LLP

(57) ABSTRACT

This invention relates to a novel design of reinforced soil arch which can be used to construct bridges, overpasses, snowsheds, landslide or rock fall protection structures, and the like. More particularly, this invention pertains to an innovative use of mineral soil (clay, silt, sand, gravel, cobbles, boulders, broken rock or mixtures of any or all of the foregoing) to construct a reinforced soil arch that can be used for numerous purposes. A method of constructing a reinforced soil arch comprising constructing an arch utilizing a combination of layers of compacted mineral soil and reinforcement in a manner that supports both the dead load of the structure and a live load imposed on the structure.

16 Claims, 6 Drawing Sheets

Cross-section

Cross-section

Geotextile Reinforced Soil Arch Concept

Cross-section

Cross-section

*Cross-section*

Plan View of Wire Mesh Connection Detail

Cross-section

Cross-section

REINFORCED SOIL ARCH

REFERENCE TO RELATED APPLICATION

This application claims the benefit of provisional application. Ser. No. 60/452,949, filed Mar. 10, 2003.

FIELD OF THE INVENTION

This invention relates to a novel design of reinforced soil arches which can be used to construct bridges, overpasses, underpasses, snowsheds, landslide and rock fall protection structures, and the like. More particularly, this invention pertains to an innovative use of mineral soil (clay, silt, sand, gravel, cobbles, boulders, broken rock or mixtures of any or all of the foregoing) to construct a reinforced soil arch that can be used for numerous purposes.

BACKGROUND OF THE INVENTION

Bridges, culverts, overpasses, and the like, are traditionally constructed of expensive and environmentally incompatible steel structures, reinforced concrete structures, plastic structures and the like. For instance, bridges are usually constructed using concrete and/or steel foundations supporting pre-stressed concrete spans or suspended concrete and/or steel spans extending between the supports. Culverts used in road construction are usually constructed of concrete, corrugated steel or corrugated plastic pipes or arches. Steel and concrete arch structures are usually constructed on concrete or steel footings. Installation of these footings is often a significant component of the cost of the arch installation and often involves excavation below the level of the stream bed. This can result in damage to the stream and introduction of sediment to the stream or costly mitigation techniques to prevent or limit the extent of damage and sedimentation. Snowsheds and avalanche sheds used in highway and railway construction are usually constructed as concrete and/or steel bridge-like structures, often in the form of an arch. Such structures must be designed to accommodate large, unbalanced loads. Otherwise the steel structures will topple and collapse.

A problem with concrete, corrugated metal culverts and corrugated plastic culverts is that with freeze/thaw cycles, water erosion and dynamic vehicle loads on the culverts, the soil compacted around the concrete, steel or plastic culverts can become loose and erode away, thereby leaving an uneven load distribution on the culvert. When this occurs, the uneven load distribution may be sufficient to cause the culvert to collapse. The undermining of footings supporting steel, concrete or plastic arches can result in the loss of support for the soil compacted around the arch. This can result in uneven loading on the structure and possible collapse. Then the roadway may need to be closed for a period of time while the structure is repaired or replaced.

The geotextile reinforced soil arch structure, according to the invention, because it does not require the use of expensive self-supporting steel, concrete or plastic structures, or the like, enables roads, bridges, snowsheds, archways, and the like, to be constructed for considerably less money than conventional structures.

The following patents disclose subject matter that is more or less relevant to the subject invention:

U.S. Pat. No. 4,618,283, Hilfiker, Oct. 21, 1986

U.S. Pat. No. 6,050,746, McCavour et al., Apr. 18, 2000

Canadian Patent No. 1,056,169, Fisher, Jun. 12, 1979

Canadian Patent No. 1,340,179, Kennedy et al., Nov. 23, 1988

Canadian Application No. 2,254,595, McCavour et al., filed Nov. 27, 1998

SUMMARY OF INVENTION

This invention relates to an innovative reinforced soil arch design. More particularly, the invention pertains to an innovative use of mineral soil (clay, silt, sand, gravel, cobbles, boulders, broken rock or mixtures of any or all of the preceding) to construct a reinforced soil arch. The invention uses alternating layers of compacted soil and reinforcement consisting of geosynthetics, plastic, metal and/or the like, constructed in the form of an arch that supports both the dead load of the structure and the live load imposed on the structure. The construction of the reinforced soil arch requires the use of an arch shaped form to aid in construction of the soil arch, provide confinement for the soil, and prevent raveling of the soil following construction. The form is used for the purpose of constructing the soil arch and is not a major load carrying element of the structure. The form may consist of metal, concrete, reinforced concrete, plastic or reinforced plastic. The form is not limited to an arch shape and may consist of a reentrant arch, vertical or horizontal ellipse, pear or box-shaped or curved overpass/underpass structure.

An important feature of the invention is that no permanent footing is required for the structure. However, in some situations, it may be necessary to found the form on either a temporary or an elastic footing to facilitate construction and long-term performance. This footing does not require embedment (burial). This allows for the crossing of environmentally sensitive areas (such as streams) without significant excavation into the sensitive areas.

The invention is directed to a method of constructing a reinforced soil arch utilizing a combination of layers of compacted mineral soil and reinforcement in a manner that supports both a dead load of the structure and a live load imposed on the structure.

An archway form is installed for initially supporting the combination of compacted soil and reinforcement. The reinforcement can consist of geosynthetic, plastic, metal, wood and/or the like, materials. The archway form is secured to the reinforced soil by welded wire mesh, bars or other means to enable the form to move with the reinforced soil. The arch shape may be in the form of a reentrant arch, a vertical or horizontal ellipse, a pear or box-shaped structure, or a curved overpass or underpass structure. The forms can be installed on a temporary or yielding footing and the reinforced soil arch cooperates with the temporary footing.

The invention is also directed to a reinforced soil arch constructed of a combination of soil and reinforcements. The reinforcement can consist of geosynthetic, plastic, metal, wood or like materials. The arch shape may be in the form of a reentrant arch, a vertical or horizontal ellipse, a pear or box-shaped structure, or a curved overpass or underpass structure. The form can be installed on a temporary or elastic footing and the reinforced soil arch cooperates with the temporary or elastic footing.

BRIEF DESCRIPTION OF DRAWINGS

In drawings which illustrate specific embodiments of the invention, but which should not be construed as restricting the spirit or scope of the invention in any way:

FIG. 6 illustrates a cross-section view of an eccentrically loaded arch according to the invention, which can be used for snowsheds, landslide or rockfall protection structures, and the like.

DESCRIPTION

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense.

Figure 1:
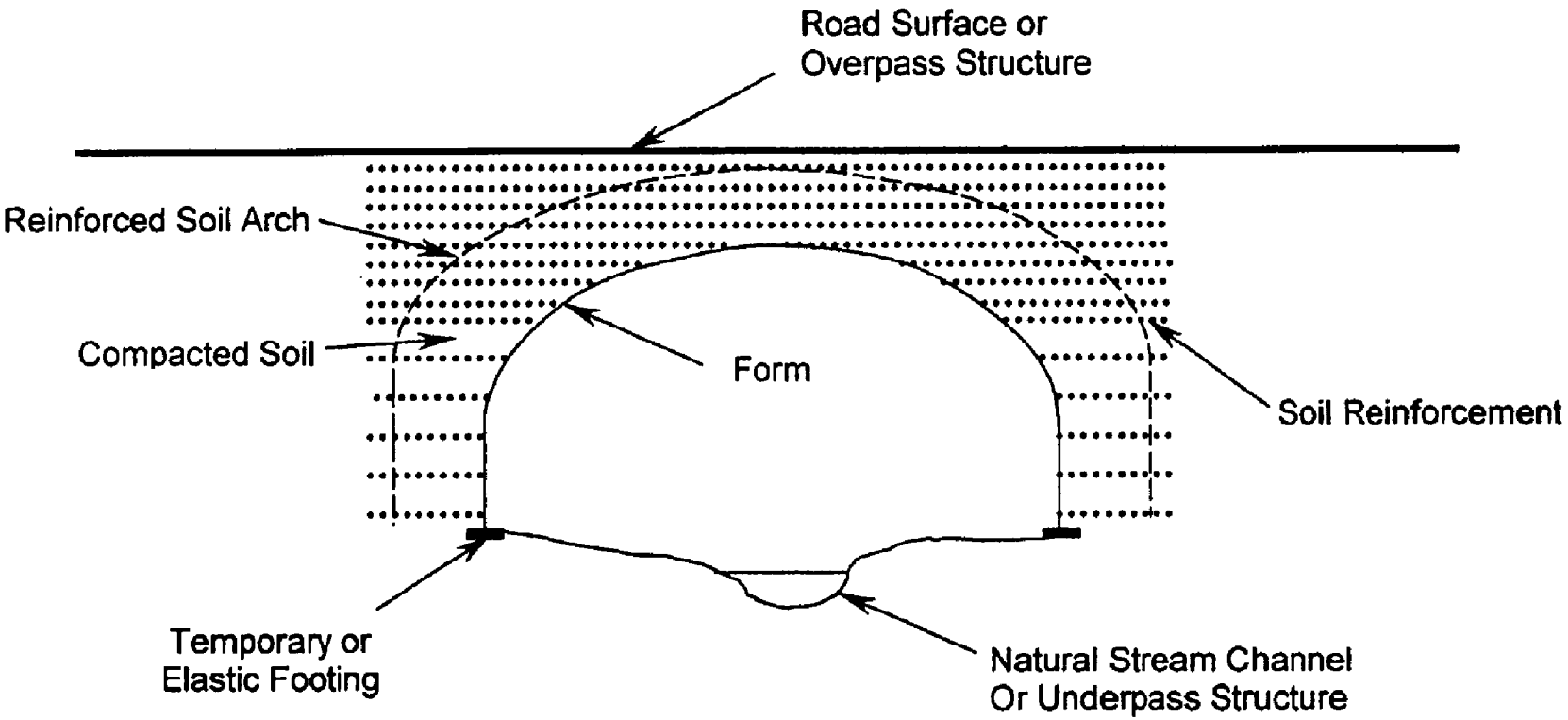
FIG. 1 illustrates a cross-section view of a reinforced soil arch according to the invention.

Referring to the drawings, FIG. 1 illustrates a cross-section view of the reinforced soil arch structure according to the invention. FIG. 1 shows a reinforced soil arch over a natural stream channel or underpass structure consisting of alternating layers of compacted soil and reinforcement surrounding an arch-like form structure which rests on a temporary elastic footing. The reinforced soil supports a road surface or other overpass structure. The selection of backfill, soil type, soil reinforcements, form type, shape and size, footing type, soil reinforcement spacing, orientation, length and the like, are all based on specific site constraints according to the location where the reinforced soil arch will be installed and the loading requirement.

Figure 2:
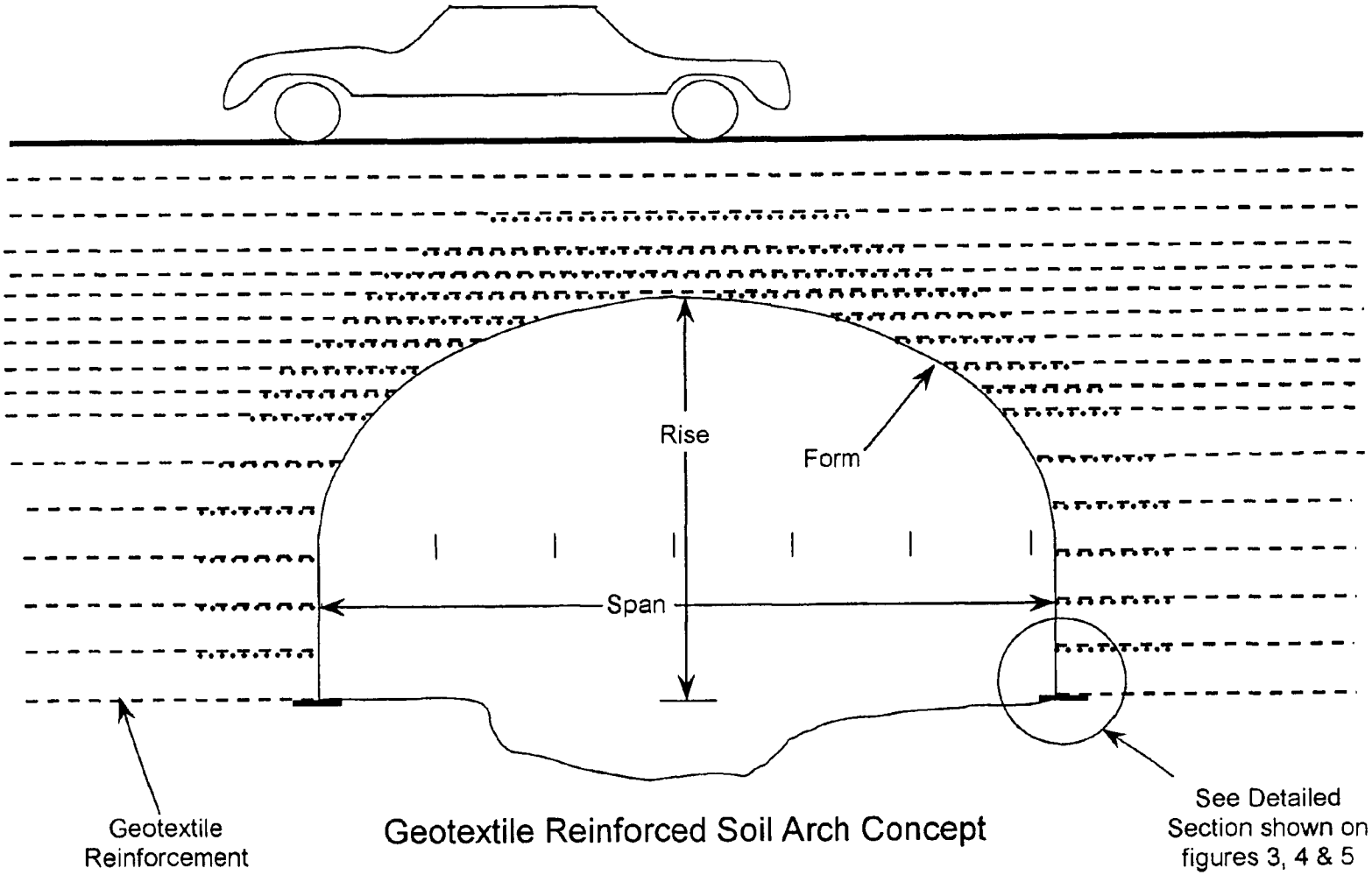
FIG. 2 illustrates a detailed cross-section view of a geotextile reinforced soil arch structure according to the invention.

FIG. 2 illustrates a detailed cross-section view of a geotextile reinforced soil arch according to the invention. As can be seen in FIG. 2 by the emboldened areas, the reinforced soil is constructed in the shape of an arch over the form which comprises the underside of the arch. As seen in FIG. 2, the reinforced soil arch is roughly twice as wide as its height. However, it will be understood that other dimensions and other forms of the reinforced soil arch can be used according to the invention.

Figure 3:
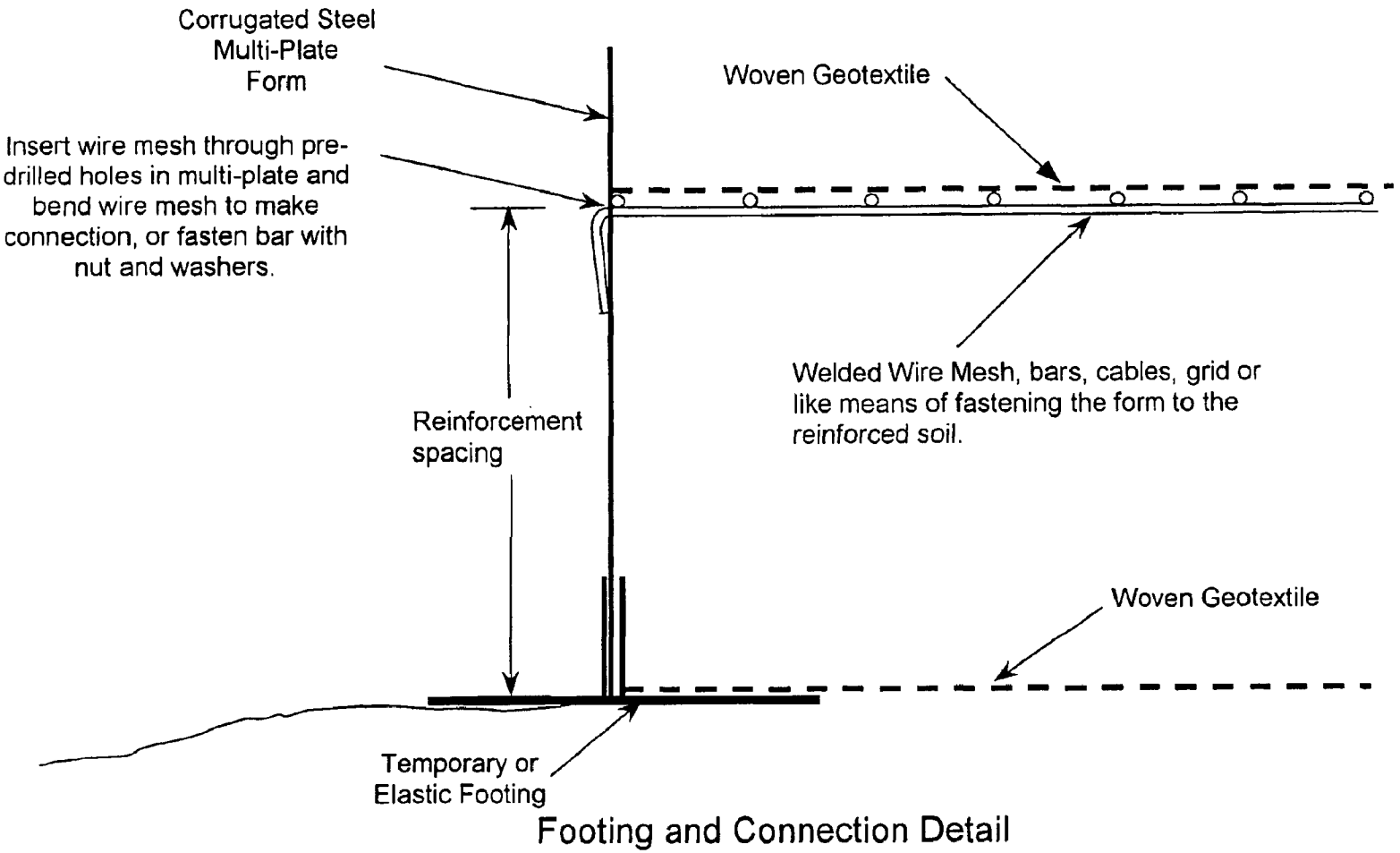
FIG. 3 illustrates a cross-section view of the footing and reinforcement connection detail identified by the circle of FIG. 2.

FIG. 3 illustrates a cross-section view of the footing and reinforcement connection detail that is identified by the circle of FIG. 2. As seen in FIG. 3, the reinforced soil arch structure may be constructed from a combination of corrugated steel multiplate, woven geotextile and wire mesh or bars. The wire mesh is inserted through pre-drilled holes in the multiplate and the wire mesh is bent to make a connection to the corrugated steel multiplate. Bars may be secured to the corrugated steel form by nuts or like methods of connection. Woven geotextile is also placed at the base of the structure immediately above the temporary or elastic footing. It should be understood that in certain applications, an elastic footing may be needed depending on specific site conditions.

Figure 4:
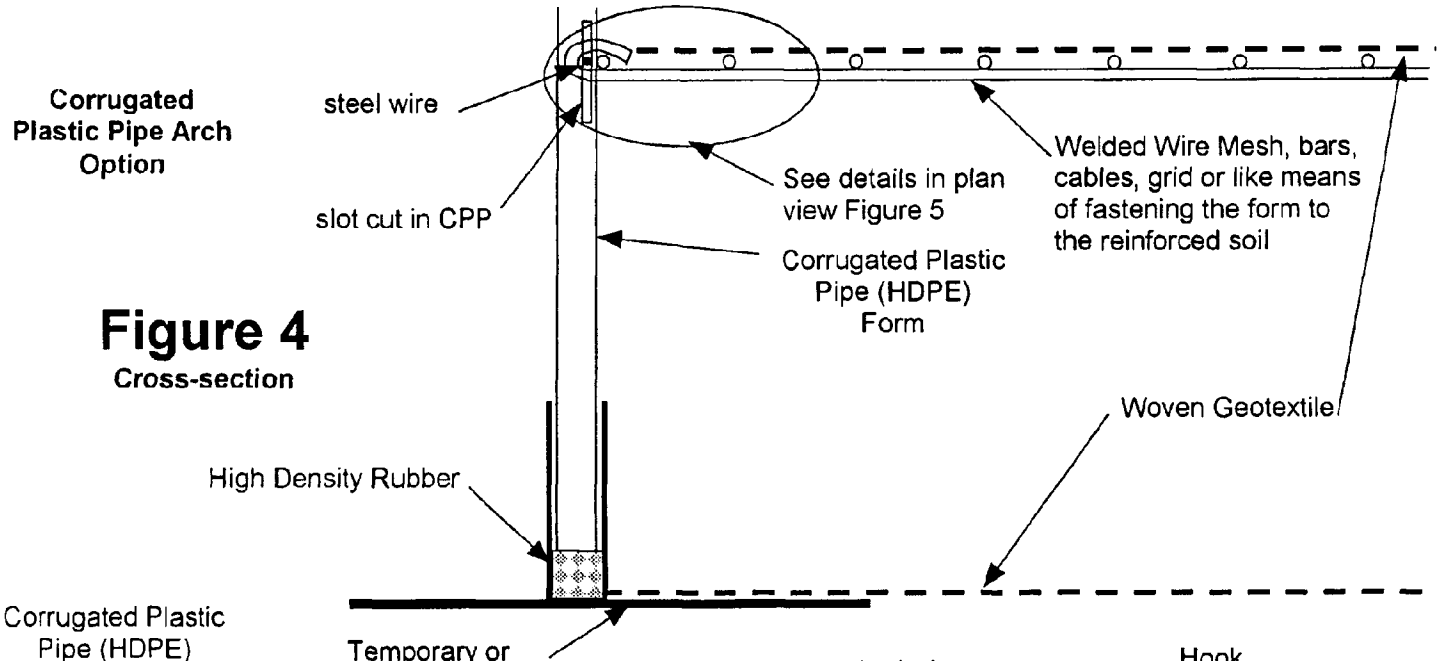
FIG. 4 illustrates a cross-section view of a corrugated plastic pipe arch of a design similar to that shown in FIG. 3.

FIG. 4 illustrates a structure similar to that shown in FIG. 3 except that corrugated plastic pipe is used rather than steel. Geotextile and welded wire mesh are shown, similar to the structure shown in FIG. 3. The form is corrugated plastic pipe, such as high density polyethylene. FIG. 4 also shows a temporary or elastic footing. The elastic footing may not be needed, depending on specific site requirements. An arrangement of metal bars could also be used in place of the wire mesh.

Figure 5:
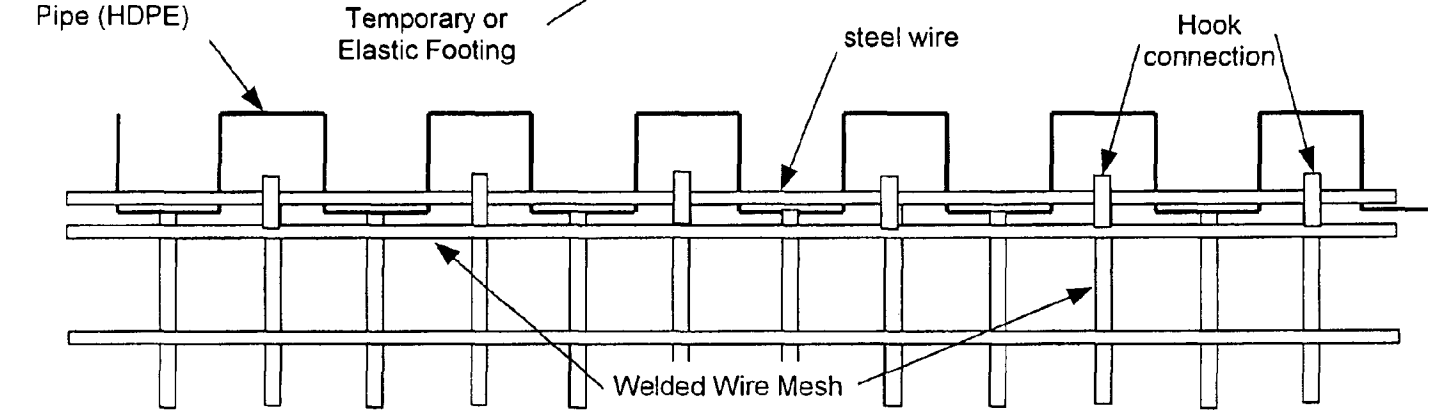
FIG. 5 illustrates a detailed plan view of the structure identified by the oval of FIG. 4.

FIG. 5 illustrates an enlarged plan view of the structure highlighted by the oval of FIG. 4. FIG. 5 shows the inter-cooperation of corrugated plastic pipe, which can be constructed of high density polyethylene, with the welded wire mesh and the hook connections of the welded wire mesh with the corrugated plastic pipe. Alternatively, metal bars can be fastened to the corrugated plastic.

Figure 6:
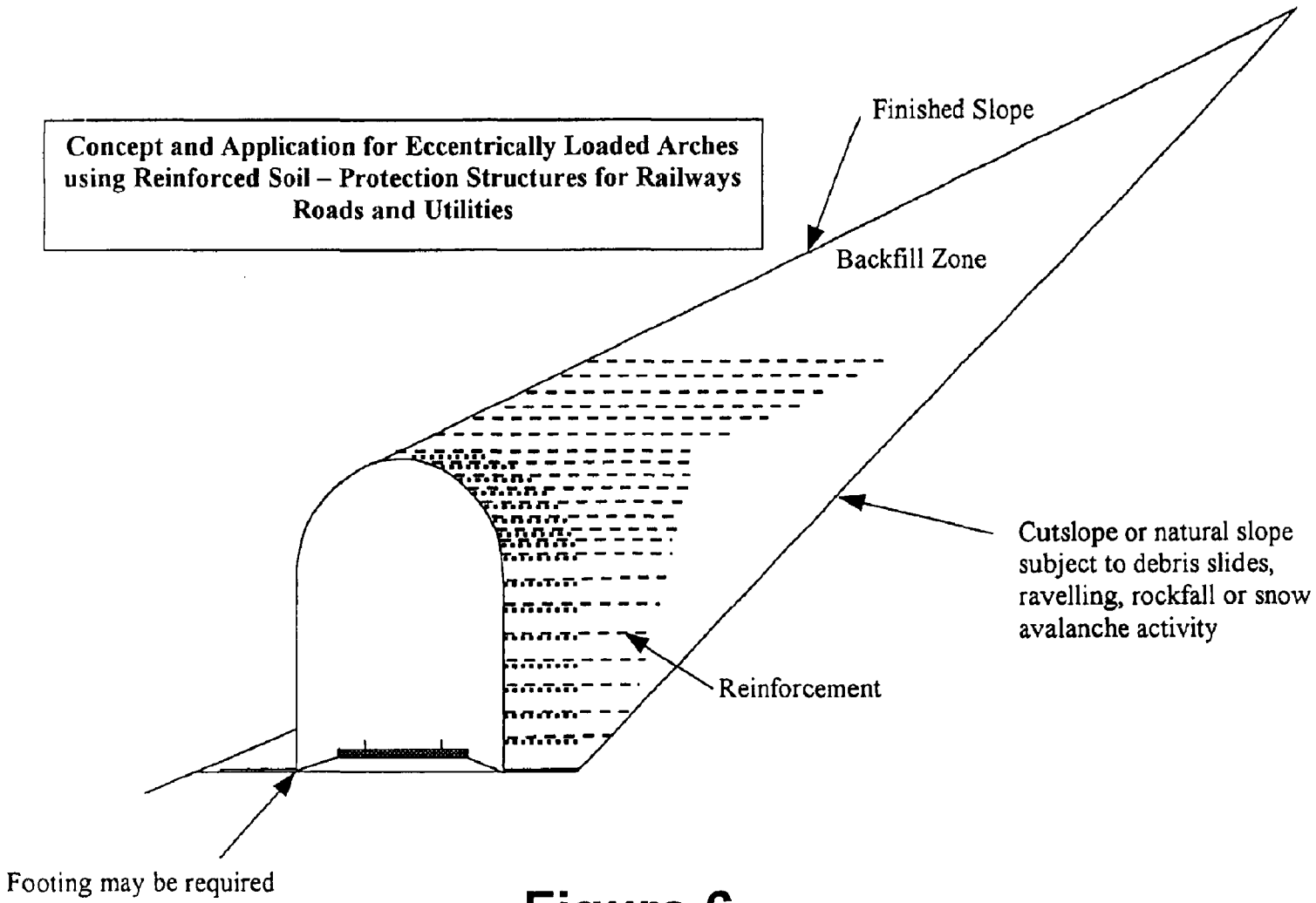

FIG. 6 illustrates a cross-section view of an eccentrically loaded soil arch constructed of geotextile reinforced soil, suitable for constructing snowsheds, avalanche sheds and the like. FIG. 6 illustrates an optional footing, which may be required in certain instances. Such snowsheds and avalanche or landslide sheds are useful for protecting railway beds, motor vehicle highways, utility installations, and the like. FIG. 6 is notable in that the geotextile reinforced soil arch, according to the invention, accommodates the non-symmetric nature of those types of structures. In conventional steel, concrete and plastic arch structures, the structures must be evenly loaded or designed to accommodate eccentric loading. Conventional structures designed and constructed to resist eccentric loads are typically expensive. However, in the subject invention, the geotextile reinforced soil arch enables an eccentric load to be supported economically. The geotextile reinforced soil arch can be constructed where landscape slopes are subject to debris slides, raveling, rock fall, snow avalanche activity, or like hazards.

Figure 7:
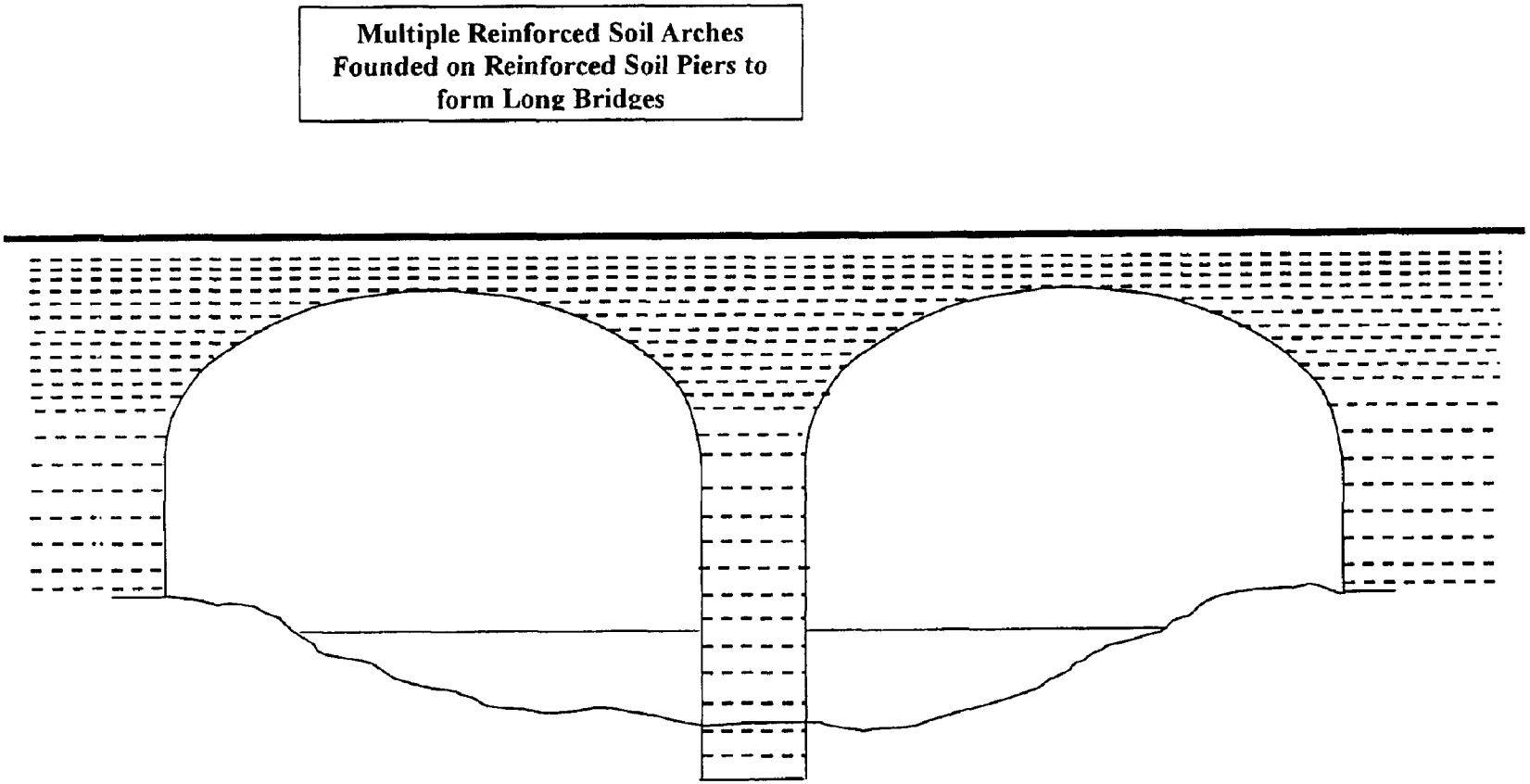
FIG. 7 illustrates a cross-section view of a multiple arch structure according to the invention used to construct long bridges.

FIG. 7 illustrates a cross-section view of a multiple arch structure. The geotextile reinforced soil arch according to the invention can be constructed in a series to form multiple arches for the purpose of building longer bridges, overpasses, underpasses, and the like. The geotextile reinforced soil arch structure, according to the invention, because it does not require the use of expensive self-supporting steel structures or concrete structures, or the like, enables roads, bridges, snowsheds, archways, and the like, to be constructed for considerably less money than conventional structures.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A method of constructing a self-standing reinforced soil arch comprising (a) placing a pair of parallel temporary footings on the ground of the location where the soil arch is to be erected;

(b) placing on the pair of parallel temporary footings an archway form which straddles the pair of parallel temporary footings;

(c) erecting adjacent to and on the form a combination of alternating and interacting layers of compacted mineral soil and reinforcement material which combination supports both the dead load of the soil arch and the live load imposed on the soil arch without applying any appreciable permanent weight to the form;

(d) connecting the archway form to the reinforced soil; and (e) removing the pair of parallel temporary footings.

2. A method as claimed in claim 1 wherein the archway form is installed for initially supporting the combination of compacted soil and reinforcement material.

3. A method as claimed in claim 1 wherein the archway form is supported by the reinforcement soil.

4. A method as claimed in claim 3 wherein the archway form is connected to the compacted soil and reinforcement material by wire mesh, bars, or connection members so that the archway form moves with the reinforced soil.

5. A method as claimed in claim 1 wherein the reinforcement material consists of geosynthetic, plastic, metal, or wood.

6. A method as claimed in claim 1 wherein the soil arch may be in the form of a reentrant arch, a vertical or horizontal ellipse, a pear or box-shaped structure, or a curved overpass or underpass structure.

7. A method as claimed in claim 1 wherein the reinforced soil arch is constructed of a combination of corrugated steel, woven geotextile and wire mesh, the wire mesh being inserted through pre-driled holes in the corrugated steel.

8. A method as claimed in claim 1 where the reinforcement material comprises woven geotextile.

9. A method as claimed in claim 1 where the reinforcement material is not connected to the form.

10. A self-standing reinforced soil arch comprising:

(a) a pair of parallel temporary footings on a ground site;

(b) an archway form which straddles the pair of temporary footings;

(c) an archway adjacent to and on the form constructed of a combination of alternating and interacting layers of compacted mineral soil and reinforcement material which combination supports both the dead load of the soil arch and any live load imposed on the soil arch without applying any appreciable permanent weight to the form; the form is attached to the reinforced soil but not necessarily the soil reinforcement, the pair of parallel temporary footings being removed after the soil arch is formed.

11. A reinforced soil arch as claimed in claim 10 wherein the reinforcement material consists of geosynthetic, plastic, metal, or wood.

12. A reinforced soil arch as claimed in claim 10 wherein the reinforced soil arch may be in the form of a reentrant arch, a vertical or horizontal ellipse, a pear or box-shaped structure, or a curved overpass or underpass structure.

13. A reinforced soil arch as claimed in claim 10 wherein the reinforced soil arch is constructed of a combination of corrugated steel, woven geotextile and wire mesh or bars, the wire mesh being inserted through pre-drilled holes in the corrugated steel.

14. A reinforced soil arch as claimed in claim 10 where the soil reinforcement is connected to the form.

15. A reinforced soil arch as claimed in claim 10 where the soil reinforcement is not connected to the form.

16. A reinforced soil arch as claimed in claim 10 wherein the soil and reinforcement material are a combination of layers of compacted mineral soil and woven geotextile.

* * * * *